US011399689B2

(12) United States Patent
Lutz et al.

(10) Patent No.: US 11,399,689 B2
(45) Date of Patent: Aug. 2, 2022

(54) DISHWASHER COMPRISING AT LEAST ONE FAN IMPELLER IN THE DISHWASHING COMPARTMENT

(71) Applicant: BSH Hausgeräte GmbH, Munich (DE)

(72) Inventors: Stephan Lutz, Zusamaltheim (DE); Thomas Burggraf, Dillingen (DE); Michael Georg Rosenbauer, Reimlingen (DE)

(73) Assignee: BSH Hausgeräte GmbH, Munich (DE)

( * ) Notice: Subject to any disclaimer, the term of this patent is extended or adjusted under 35 U.S.C. 154(b) by 47 days.

(21) Appl. No.: 16/622,958

(22) PCT Filed: Jul. 4, 2018

(86) PCT No.: PCT/EP2018/068126
§ 371 (c)(1),
(2) Date: Dec. 16, 2019

(87) PCT Pub. No.: WO2019/015969
PCT Pub. Date: Jan. 24, 2019

(65) Prior Publication Data

US 2021/0145246 A1 May 20, 2021

(30) Foreign Application Priority Data

Jul. 18, 2017 (DE) ..... 10 2017 212 300.1
Dec. 19, 2017 (DE) ..... 10 2017 223 255.2
Dec. 19, 2017 (DE) ..... 10 2017 223 272.2

(51) Int. Cl.
*A47L 15/48* (2006.01)
*A47L 15/00* (2006.01)
*A47L 15/42* (2006.01)

(52) U.S. Cl.
CPC ..... *A47L 15/0013* (2013.01); *A47L 15/0034* (2013.01); *A47L 15/4246* (2013.01);
(Continued)

(58) Field of Classification Search
CPC ..... A47L 15/00–508
See application file for complete search history.

(56) References Cited

U.S. PATENT DOCUMENTS 1,226,428 A * 5/1917 Winters ..... A47L 15/06 134/186
2008/0264458 A1* 10/2008 Berner ..... A47L 15/488 134/57 D (Continued)

FOREIGN PATENT DOCUMENTS

CN 106388743 A 2/2017
DE 532341 C 8/1931

(Continued)

OTHER PUBLICATIONS

International Search Report PCT/EP2018/068126 dated Nov. 20, 2018.

*Primary Examiner* — Michael E Barr
*Assistant Examiner* — Omair Chaudhri
(74) *Attorney, Agent, or Firm* — Michael E. Tschupp; Andre Pallapies; Brandon G. Braun

(57) ABSTRACT

A dishwasher, in particular household dishwasher, includes a dishwasher cavity for receiving an item to be washed, a rotatable fan wheel arranged in the dishwasher cavity and configured to draw in air and to blow out the air, and a motor operably connected to the fan wheel and operating at a rotational speed which is variable over time.

12 Claims, 5 Drawing Sheets

(52) U.S. Cl.
CPC ..... *A47L 15/4274* (2013.01); *A47L 15/486* (2013.01); *A47L 15/488* (2013.01)

(56) References Cited

U.S. PATENT DOCUMENTS

| | | | | |
|---|---|---|---|---|
| 2011/0048342 | A1* | 3/2011 | Vroom | A47L 15/4291 122/367.1 |
| 2011/0120500 | A1* | 5/2011 | Heisele | A47L 15/0049 134/25.2 |
| 2012/0006360 | A1* | 1/2012 | Rosenbauer | A47L 15/0047 134/18 |
| 2013/0171009 | A1* | 7/2013 | Vogt | F04D 27/008 417/53 |
| 2014/0170954 | A1* | 6/2014 | Hintz | A47L 15/486 454/251 |
| 2016/0296098 | A1* | 10/2016 | Dries | A47L 15/06 |
| 2017/0311771 | A1 | 11/2017 | Lutz et al. | |

FOREIGN PATENT DOCUMENTS

| | | | | | |
|---|---|---|---|---|---|
| DE | 102013014553 | A1 | | 11/2013 | |
| DE | 102013014553 | A1 | * | 11/2013 | A47L 15/483 |
| DE | 102013202103 | A1 | | 8/2014 | |
| DE | 102014222539 | A1 | * | 5/2016 | A47L 15/0034 |
| DE | 102015013364 | A1 | | 4/2017 | |
| FR | 2649001 | A1 | | 1/1991 | |
| GB | 1530734 | A | * | 11/1978 | A47L 15/486 |
| JP | 2004283209 | A | | 10/2004 | |
| JP | 2006340996 | A | | 12/2006 | |
| JP | 2007117553 | A | | 5/2007 | |
| JP | 2009136654 | A | | 6/2009 | |

* cited by examiner

DISHWASHER COMPRISING AT LEAST ONE FAN IMPELLER IN THE DISHWASHING COMPARTMENT

CROSS-REFERENCES TO RELATED APPLICATIONS

This application is the U.S. National Stage of International Application No. PCT/EP2018/068126, filed Jul. 4, 2018, which designated the United States and has been published as International Publication No. WO 2019/015969 A1 and which claims the priorities of German Patent Applications, Serial No. 10 2017 212 300.1, filed Jul. 18, 2017, Serial No. 10 2017 223 272.2, filed Dec. 19, 2017, and Serial No. 10 2017 223 255., filed Dec. 19, 2017, pursuant to 35 U.S.C. 119(a)-(d).

BACKGROUND OF THE INVENTION

The present invention relates to a dishwasher, in particular a household dishwasher, comprising a dishwasher cavity for receiving dishware, glasses, cutlery or similar items to be washed.

In a conventional washing program, a dishwasher runs through one or more liquid-carrying partial wash cycles, for example a pre-wash cycle, a cleaning cycle, an intermediate wash cycle and a rinse cycle with rinse-aid. A drying cycle is usually performed thereafter. During the respective liquid-carrying partial wash cycle, liquid, in particular water, which possibly may be mixed with detergent or rinse-aid, i.e. what is known as washing liquor, may be introduced into the dishwasher cavity via one or more liquid distribution apparatuses, where it is distributed. The respective liquid distribution apparatus may for example be formed by a rotating spray arm, by a ceiling-mounted shower and/or by a movable spray nozzle, such as a ceiling-mounted spinning head for example. With the aid thereof, it becomes possible to apply washing liquor directly or indirectly to the items to be washed which are held there in loading units, for example pull-out baskets and/or cutlery drawers.

In order to dry the respective item to be washed as well as possible at the end of the washing program, various drying methods are known. These are, in particular, what is known as internal heat drying, condensation drying (in particular by means of a heat exchanger on a side wall of the dishwasher cavity for the cooling thereof), drying with support by a fan system with air from the room being blended in, drying by opening the door at the end of the drying cycle, sorption drying with a zeolite for example, etc. These methods in particular cause liquid droplets, which adhere to the respective item to be washed after the final liquid-carrying partial wash cycle, to be dried away.

However, if, during the liquid-carrying partial wash cycle, liquid accumulates in an upwardly projecting depression, e.g. dip, concave area or other cavity in an item to be washed, and is left behind at the top of said area, then the quantity of liquid left behind is often too great to be dried away by a conventional drying system. This remaining standing liquid can generally only be disposed of by manually pouring it away from the top of the respective item to be washed and/or by the user drying by means of a dish towel, which is inconvenient and time-consuming. Additionally, such puddles in depressions of items to be washed may lead to unsightly deposits or water stains which stubbornly cling to the items after the drying cycle, as dirt particles, cleaning agents, rinse-aid, calcium and/or other additional substances may be contained in the liquid left behind, which may remain after the partial or complete drying out of the puddles in the respective depression.

To remedy this, DE 10 2014 222 539 A1 provides inter alia one or more exhaust openings to apply air to the dishwasher cavity, which may be assigned a movable mechanical control means, such as an air baffle, a variable-direction nozzle, a movable flap or the like, so that the exit cross-section and/or the exit direction of the air varies over the drying phase.

The problem underlying the invention is that of providing an alternative drying option, with the aid of which quantities of liquid in topside depressions in particular, such as hollows, dips, concave areas or other cavities can largely be removed from items to be washed held in one or more loading units.

BRIEF SUMMARY OF THE INVENTION

The invention solves the problem by a subject matter with the features of claim 1 or claim 9. For advantageous embodiments and developments of the invention, reference is made to claims 2 to 8 and 10 to 21.

In a dishwasher according to an embodiment of the present invention, at least one rotatable fan wheel is arranged in the dishwasher cavity, with which air is able to be drawn in on one side and blown out on the other, wherein the at least one fan wheel is assigned a motor, the rotational speed of which can be varied over time. As a result, e.g. after the end of the liquid-applying operation of the final liquid-carrying partial wash cycle, in particular the rinse cycle with rinse-aid, of the wash cycle of the dishwashing program to be performed at the time, air currents which differ in particular with regard to their flow velocities or flow impulses can be generated by the respective fan wheel over time, to dry the one or more items to be washed. In other words, the respective fan wheel may over time emit air currents with different intensities as a function of its rotational speed. Thus, in accordance with an advantageous development of the invention, e.g. after the end of the liquid-applying operation of the final liquid-carrying partial wash cycle, in particular the rinse cycle with rinse-aid, of the wash cycle of the dishwashing program to be performed at the time, first the respective fan wheel can be operated during a blowing-off operating phase with a high rotational speed for blowing out quantities of liquid which have been left behind on the top side, in particular in depressions, of the items to be washed, and possibly can then be operated during a subsequent or later convection drying phase (for generating a desired convection in the receiving chamber of the dishwasher cavity) with a lower rotational speed by comparison.

By varying the rotational speed of the respective fan wheel, this is able to conduct air currents with varying flow velocities or varying flow impulses to the items to be washed for drying. By varying the rotational speed, the noise level can also be varied. Thus, over a further time portion, the volume can be kept low, while a high rotational speed, which is also associated with an increased noise level, is only set over a relatively brief time.

At a lower rotational speed, it is possible to compel a convection/flow in the dishwasher cavity which is also active between the individual items to be washed, meaning that shadow regions are reduced. This flow improves the removal of moisture on the surface of the dishware. As a result, the temperature during rinsing with rinse-aid can possibly be reduced and thus energy can be saved. At a high rotational speed, by contrast, such a high flow velocity of the air current emitted by the respective fan wheel can be generated that water puddles in cup bottoms, which in particular project upward, in bowl bottoms or in other depressions, preferably on the top side, of items to be washed are blown out over the edge of the respective depression and, in the drying process which then follows, only the damp surface of the items to be washed which is wet with very small liquid droplets still has to be dried.

In particular, a corresponding fan wheel is able to be driven via a motor with regulable rotational speed. This may preferably be an electronically commutated synchronous motor, which may preferably be a excited by a permanent magnet. The rotational speed of such an electronically commutated synchronous motor is easy to regulate.

If the at least one motor, which is assigned to the fan wheel or the plurality of fan wheels, is able to be operated in a rotational speed range between 1,500 revolutions to 12,000 revolutions per minute, then the different operating ranges in question are realized highly effectively. Thus, for operation at 1,000 to 5,000 revolutions per minute, it is possible to support the convection with a low noise level, whereas it is possible to perform a blowing-out for a brief period of time at a rotational speed range from 5,000 to 12,000 revolutions. The higher volume associated therewith is acceptable for a brief time, particularly if the one or more brief boosts each last less than 120 seconds. Preferably, the boost in rotational speed of the motor assigned to the respective fan wheel, in particular electric motor, may last around 90 seconds.

In accordance with an advantageous development of the invention, a boost in the rotational speed of the motor assigned to the respective fan wheel is preferably able to be carried out during a blowing-off phase before the continuous operation following in time, wherein the rotational speed of the motor during the blowing-off phase is greater, in particular at least 20% greater, than the rotational speed of the motor during the continuous operation following in time. The blowing-off phase may preferably take place after the end of the liquid-carrying operation of the final liquid-carrying partial wash cycle, in particular rinse cycle with rinse-aid, if the recirculating pump has stopped its operation or has such a low rotational speed that washing liquid no longer travels over the one or more spray devices or, expressed more generally, liquid distribution devices, to strike the items to be washed, which have been washed and are now to be dried. The continuous operation of the motor may take place after the blowing-off phase, preferably during a temporary subsection or the entire remaining duration of the wash-cycle-concluding drying cycle of the wash cycle of a dishwashing program to be performed to support the convection in the dishwasher cavity.

Provided that it is possible to measure a blocking of a fan wheel via a measurement of the motor current of a motor assigned to said fan wheel in each case, it is possible for instance to easily record a blocking by an item of dishware which projects into the circle of rotation of the fan wheel. An overheating of the motor is avoided.

The control or regulation of the at least one motor preferably takes place in a sensorless manner, but may also be realized with a sensor (e.g. Hall effect sensor, rotary encoder).

If, in an embodiment of the present invention, at least one rotatable fan wheel is arranged in the dishwasher cavity, with which air is able to be drawn in on one side and blown out on the other, wherein the at least one fan wheel is assigned a motor which is embodied as a wet rotor, it is unproblematic to arrange motors of this kind in the dishwasher cavity to which water is applied. The stator region of the motor is then reliably protected from moisture in the construction manner of a wet rotor without great expenditure on sealing. A separately provided axial and/or radial sealing of the rotor chamber and/or the bearing sleeve(s) for the shaft of the rotor from liquid which penetrates during washing operation of the dishwasher is not required. Any liquid which has penetrated into the respective bearing sleeve and/or into the rotor gap of the wet-rotor motor is preferably used for the lubrication of the shaft and/or of the rotor. If the respective motor projects downward in the dishwasher cavity with the end section of its shaft, to which the fan wheel is attached, then any liquid which has penetrated is able to run downward again out from the respective bearing sleeve and/or out from the rotor gap, under some circumstances due to the force of gravity. For this reason, under some circumstances, it may be favorable to embody the wet-rotor motor as capable of running dry for a particular minimum runtime of the fan wheel, in particular propeller, assigned to it, e.g., for the runtime thereof during the respective blowing-off phase, in which the rotational speed of the wet-rotor motor is raised for a brief time.

In particular, the wet rotor comprises what is known as a motor can, which is in particular embodied in the shape of a pot. It separates a wet-running rotor from a stator which is kept in the dry. The motor therefore does not require any moving seal, which would bring associated efficiency losses and would be subject to a high degree of wear over time. The service life of the wet-rotor motor is therefore significantly increased.

The rotor may favorably comprise a ferrite ring, wherein the ferrite ring, which is particularly in one part or one piece, may have good emergency running properties in the motor can.

In accordance with an expedient development of the invention, the motor can is advantageously formed from plastic, which results in a good material combination with the ferrite ring and means that emergency running properties in particular can be ensured in the event of wear to the one or more bearings of the shaft of the motor, so that this does not lead to the motor can grinding through. This emergency running property of the motor in the event of wear to the one or more bearings of the shaft can be ensured, in particular in an improved manner, by the rotor chamber being filled with water, or another fluid medium, or fills with washing liquid during the washing operation.

As described above, the motor may be embodied as being free from a shaft sealing. A moving seal of any kind is unnecessary. In particular, this can be dispensed with at the input of the motor can between said input and the shaft.

Preferably, the structural unit consisting of shaft and rotor connected thereto in a fixed manner is mounted in the pot of the motor can in a rotating manner. A free end of the shaft projects out from the pot of the motor can. Attached thereto is the fan wheel, in particular a propeller or impeller.

A rotating bearing assembly consisting of the shaft and the rotor connected thereto in a preferably fixed manner may be favorable in particular. For such a rotating bearing assembly, provision is preferably made for an internal bearing sleeve, in particular which is arranged in a stationary manner, in which a section of the shaft is rotatably mounted which is facing away from the fan wheel, in particular propeller. This inner bearing sleeve thus provides, over its axial longitudinal extent, one or more radial bearing points, or a radial bearing which is largely continuous over its axial longitudinal extent, for the shaft. It expediently has an axial longitudinal extent which approximately corresponds to the axial length of the rotor. It may in particular assume the function of a conventional shaft bearing assembly with a first radial bearing, i.e. a so-called A-bearing, in front of the rotor and a second radial bearing, i.e. a so-called B-bearing, behind the rotor (in the viewing direction away from the fan wheel in the direction of the pot bottom of the motor can). The shaft preferably has a fixed connection to the one or more magnets, in particular magnetic bearings of the rotor accommodating a ferrite ring. This magnetic bearing is embodied as a coupling element. The magnetic bearing or the coupling element is preferably embodied in the form of a sleeve with a bottom, i.e. in the shape of a pot. The shaft stands perpendicular to the bottom of the pot-shaped coupling element and runs from its input opening facing the fan wheel toward the center of the bottom of the pot-shaped coupling element. In particular, the front-side end of the shaft facing away from the fan wheel, in particular propeller (from the opening of the pot-shaped coupling element) is guided through a through-opening in the center of the bottom of the sleeve-shaped coupling element and is grasped there in a twist-proof manner. The cylindrical jacket, in particular circular cylindrical jacket, of the sleeve-shaped coupling element may possibly have a radial gap distance from the outer surface, in particular cylindrical jacket surface, of the inner bearing sleeve. It is preferably arranged substantially concentric with respect to the inner bearing sleeve. The inner bearing sleeve plugs into the cylindrical jacket of the pot-shaped coupling element with a subsection facing away from the fan wheel, in particular propeller, preferably with its end section facing away from the fan wheel, or under some circumstances with its entire extent. Mounted around the outside of the circular cylindrical jacket of the sleeve-shaped coupling element are one or more rotor magnets, in particular permanent magnets, or a magnetic ring, and these are/this is held there. In particular, a ferrite ring can be arranged at and attached in a fixed manner to the outer circumference of the sleeve-shaped coupling element. Thus, the coupling element and the one or more rotor magnets mounted on its cylindrical jacket in a fixed manner, in particular permanent magnets, form the rotor. In this context, the rotor revolves around the inner bearing sleeve arranged in a stationary manner during rotational operation of the motor. The end face of the stationary, inner bearing sleeve facing away from the fan wheel (when viewed along the central axis of the shaft) forms a thrust ring for the base of the sleeve-shaped coupling element. It provides an axial bearing for the sleeve-shaped coupling element during rotational operation of the drive motor. As a result, during rotational operation of the electrical drive motor it is avoided that the shaft together with the rotor escapes from the pot of the motor can in the direction of the suction side of the fan wheel. The inner bearing sleeve, in a multifunctional manner, is thus able to provide at least one radial bearing for the shaft, in particular a radial twin sliding bearing or radial multiple sliding bearing, and simultaneously also an axial bearing for the unit consisting of drive shaft, coupling element and one or more rotor magnets or magnetic ring(s). Due to this advantageous construction of the electrical drive motor, the shaft is mounted on one side by its end section of the shaft, which is arranged inside the pot of the motor can and lies opposite the fan wheel, to which end section the rotor is attached in a fixed manner externally by its magnetic bearing or coupling element. This results in a flat design of the drive motor which is pushed in an axial direction (when viewed along the shaft). Compared to a conventional drive motor with one bearing for the shaft before and after the rotor, being provided separately in each case, it is shortened in terms of its axial extent.

Preferably, the material of the coupling element is chosen to be different from the material of the inner bearing sleeve, so that the inner surface of the base of the coupling element facing the fan wheel is able to slide on the end face of the inner bearing sleeve facing away from the fan wheel in a largely low-friction manner, in particular on startup of the motor. No inadmissibly high degree of abrasion, i.e. wear, is able to occur between the base of the coupling element and the end face of the inner bearing sleeve, due to the favorable material combination thereof. In particular, a metal is chosen for the coupling element, while the inner bearing sleeve is manufactured from a plastic material. The inner bearing sleeve, preferably manufactured from a plastic material, for receiving a section, in particular end section, of the shaft of the rotor is preferably mixed or provided and/or externally coated with PTFE, carbon graphite or another friction-reducer. A material is advantageously chosen for the shaft which is different from the material of the bearing sleeve. In particular, it is preferably manufactured from a metal, such as stainless steel for example. This results in a very low-wear and maintenance-free bearing assembly consisting of shaft and/or rotor, which also functions reliably over many years of continuous operation and also has very favorable dry-running properties, as a dry run cannot be ruled out.

The wet-running motor is also advantageously able to be combined with the aforementioned rotational speed properties, so that particular synergy advantages are formed.

Each fan wheel can be provided with its own drive motor, in order to minimize losses during the force transfer.

The drive motor assigned to the respective fan wheel may preferably be arranged axially above the fan wheel, so that a compact structural unit is formed from the drive motor and fan wheel in each case, which has only a very small structural height. In particular, the respective fan wheel is embodied as an axial fan. The electrical drive motor assigned to it is embodied and/or arranged such that its shaft in particular projects vertically downward. Expediently, the fan wheel is attached to the free end of the shaft which protrudes downward. The shaft is rotatably mounted in the stationary, inner bearing sleeve at the end section of the shaft, which is facing away from the fan wheel, protrudes vertically upward and is accommodated in the pot of the motor can together with the rotor unit fastened thereto. At the same time, the upwardly projecting end face of the inner bearing sleeve for the coupling element of the rotor unit provides an axial bearing, which prevents an axial escaping of the shaft with the rotor unit from the pot of the rotor can in the axial direction toward the fan wheel, when the electrical drive motor is in operation. If, in a liquid-carrying partial wash cycle, such as the cleaning cycle of the wash cycle of a dishwashing program to be performed, washing liquid is distributed in the interior of the dishwasher cavity by means of one or more liquid distribution devices, in particular is sprayed, then the washing liquid may possibly also reach the rotor chamber of the drive motor provided by the pot of the motor can from below, where it supplies a liquid lubrication of the shaft and/or the rotor. This may be favorable for a rotational operation of the drive motor later in time, e.g. during a blowing-off phase and/or the drying phase of the wash cycle.

In particular, the drive motor has an axial extent of less than four centimeters, which makes it possible for the overall structural height of the motor and fan wheel to amount to less than five centimeters. The remaining space for the items to be washed is therefore only very slightly restricted.

It is additionally possible for one or more fan wheels to be assigned to a cutlery drawer and/or one or more fan wheels to be assigned to a basket, and to use a shared frame with said cutlery drawer or basket. No separate frame is then needed for the mechanical bracket for the fan wheels, but rather these may use the loading units which are already present. A retrofitting, for instance clipping onto such loading units, perhaps may also be possible. The installation height and the number of parts can be reduced once more. If one or more fan wheels is/are held on an underside of a respective loading unit, the holding capacity of the respective loading unit is not restricted by the fan wheel(s), but rather remains intact over its entire area.

If one or more fan wheels draw in and blow out air from the closed dishwasher cavity, no outlets are required in the dishwasher cavity wall and also no valves or other additional structural units are required, meaning that the structure remains simple. Alternatively, it is also possible for air to be drawn in from the outside, for example also by the door automatically being opened by a gap.

The advantageous embodiments and developments of the invention described above advantageously may be used individually or even in any possible combination with one another.

Other advantageous developments of the invention are disclosed in the subclaims.

BRIEF DESCRIPTION OF THE DRAWINGS

The invention and its advantageous embodiments and developments as well as the advantages thereof are described below in greater detail with reference to drawings illustrating exemplary embodiments. These are schematic principle sketches in which.

DETAILED DESCRIPTION OF EXEMPLARY EMBODIMENTS OF THE PRESENT INVENTION

Figure 1:
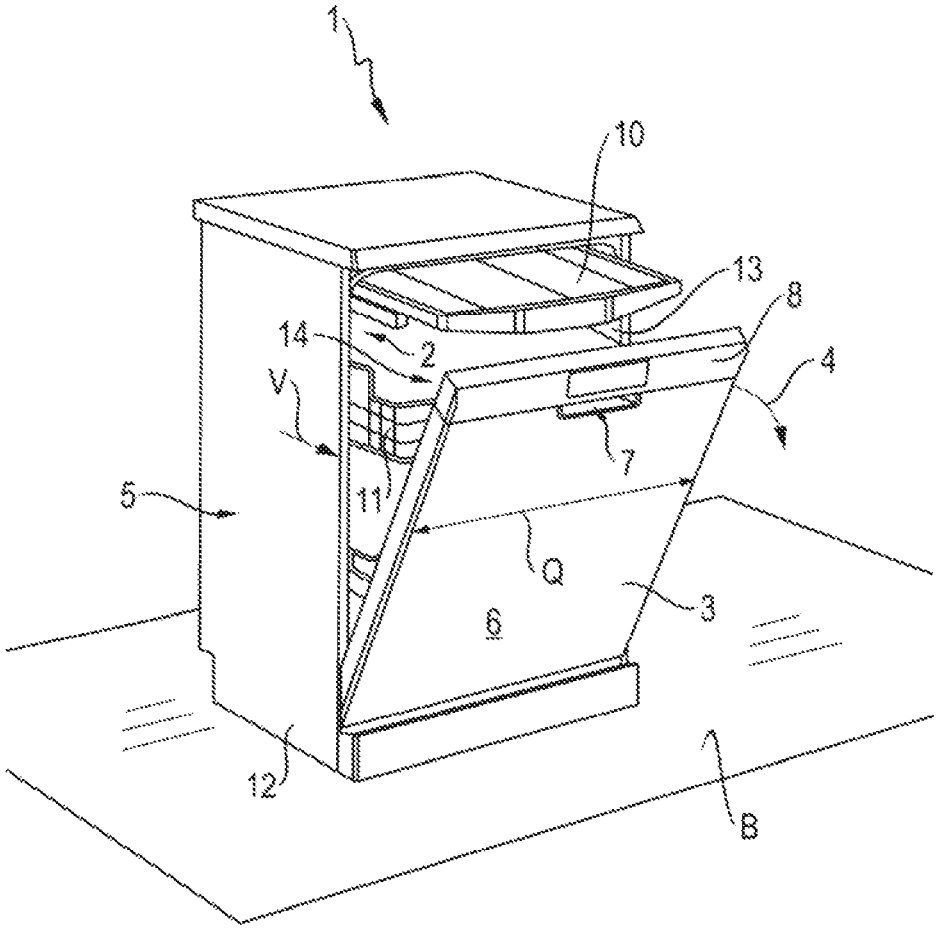
FIG. 1 shows a schematic perspective view obliquely from the front of an advantageous embodiment of a dishwasher, with a door on the front side here and a dishwasher cavity inside.
Figure 2:
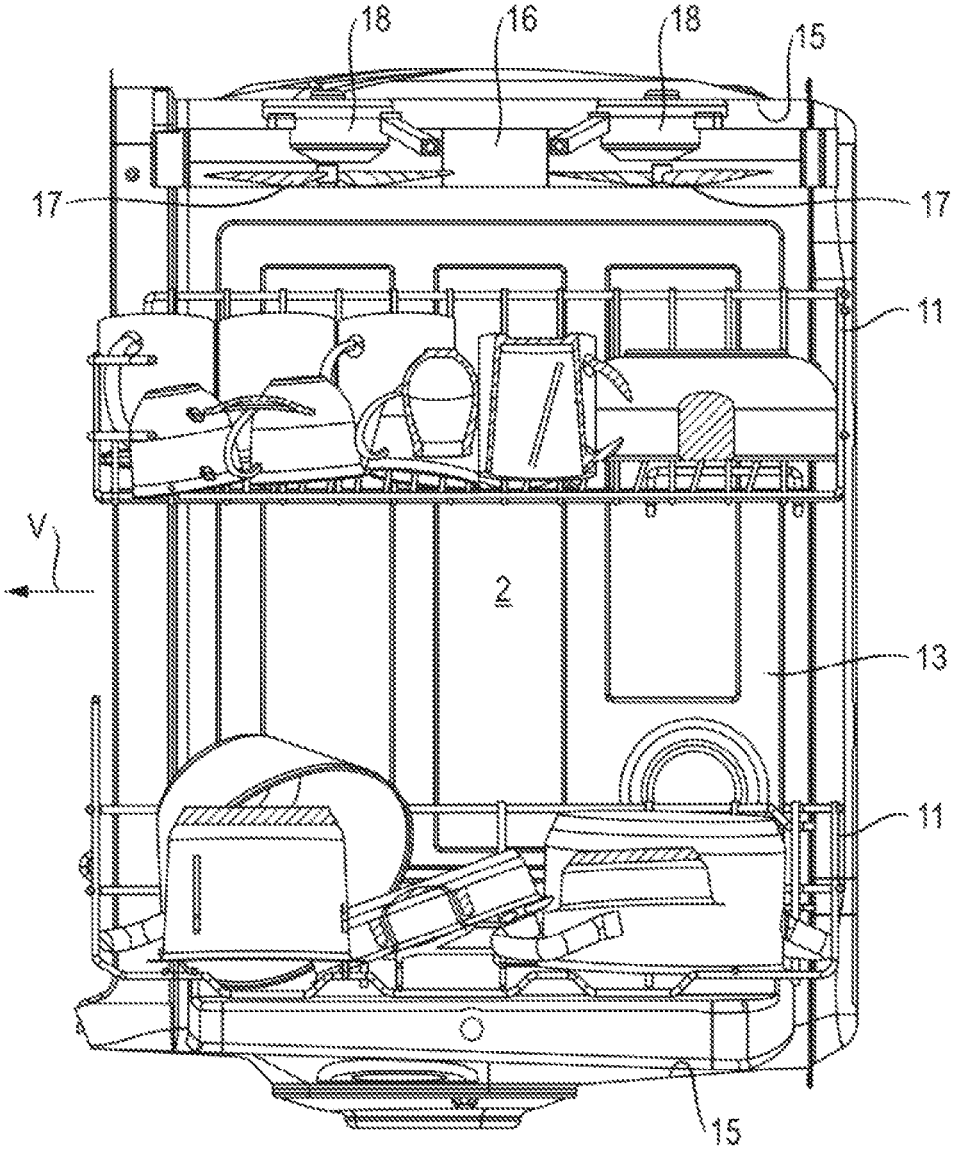
FIG. 2 shows a side view of an exemplary dishwasher cavity with two loading units filled with items to be washed and with a plurality of fan wheels in the upper region, which are able to apply air to the dishwasher cavity.
Figure 3:
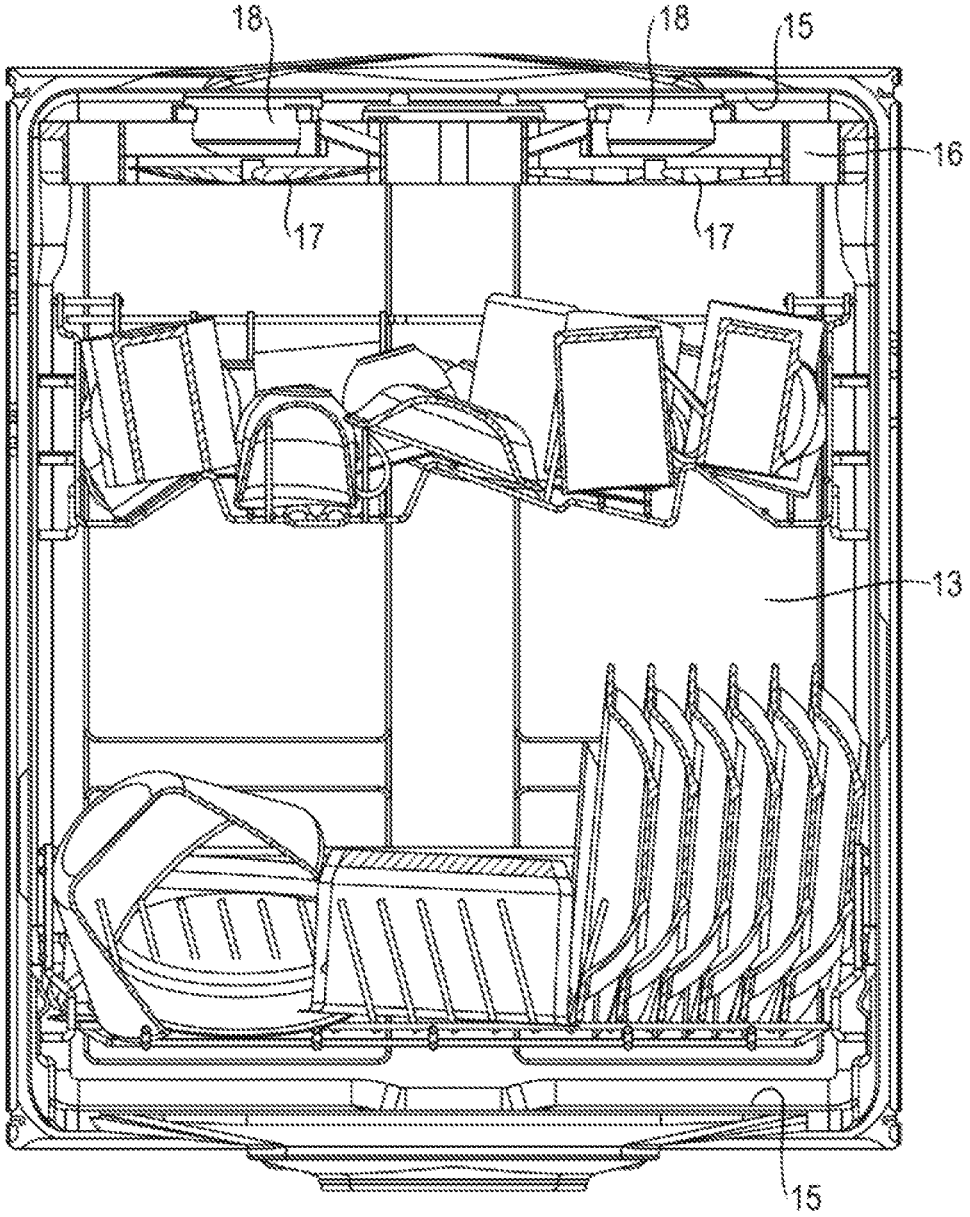
FIG. 3 shows the dishwasher cavity in a view from the front.

In FIGS. 1 to 5, corresponding parts are provided with the same reference characters. Only those elements of a household dishwasher are described and provided with reference characters that are necessary to the understanding of the invention.

The dishwasher 1 schematically represented in FIG. 1 is a household dishwasher. It has, as an element of an appliance body 5 which is partially open or closed to the outside, which is often also referred to as a carcass, a dishwasher cavity 2 for receiving items to be washed and treated such as dishware, pots, cutlery, glasses, cooking utensils and the like. Here, each item to be washed may be held for example in loading units 10, 11, in accordance with the drawing specifically in baskets 11 and/or a cutlery drawer 10, and what is known as washing liquor may be able to be applied thereto. Here, by way of example, two baskets 11 are arranged one above the other, and an additional cutlery drawer 10 is arranged in the upper region of the dishwasher cavity 2. This arrangement is not mandatory. In the case of bulky objects to be washed, for example, an upper basket 11 or the cutlery drawer 10 may also be removed by the customer for a specific wash cycle.

Washing liquor is understood to mean fresh water or in particular water circulating during operation with or without detergent and/or rinse-aid and/or desiccant. The dishwasher cavity 2 can have an at least substantially rectangular—in particular approximately square-shaped—floor plan with a front side V facing toward a user in the operating position. Here, this front side V can form a part of a kitchen front consisting of kitchen units arranged side by side, or in the case of a free-standing appliance, can also be unrelated to further units.

The dishwasher cavity 2 is able to be closed off by means of a door or flap 3, in particular on this front side V. This door 3 is shown in FIG. 1 in a partially open position, in which it is then slanted with respect to the vertical. In its closed position, on the other hand, it stands upright and is pivotable forward and downward about a lower horizontal axis in the direction of the arrow 4 according to the drawing, so that it lies at least almost horizontal in the fully opened position.

On its outer and front side V which is vertical in the closed position and faces toward the user, the door 3 can be provided with a décor panel 6 in order thus to undergo a visual and/or haptic enhancement and/or an adaptation to surrounding kitchen units.

The dishwasher 1 is embodied in this case as a free-standing or what is known as a partly integrated or fully integrated appliance. In the latter case, the appliance body 5 can also close substantially with the outer walls of the dishwasher cavity 2. A housing surrounding the latter on the outside can then be dispensed with. A base 12, in particular for receiving functional elements such as a recirculating pump for the washing liquor for example, can be disposed in the lower region of the dishwasher.

In the exemplary embodiment according to the drawing, a control panel 8 extending in the transverse direction Q of the dishwasher is assigned to the movable door 3 in its upper region, which control panel 8 can comprise an engaging opening 7 accessible from the front side V for manually opening and/or closing the door 3. In the transverse direction Q, the dishwasher often has an extent of 45, 50 or 60 centimeters. Viewed rearward in the depth direction from the front side V, the extent often also amounts to approximately 60 centimeters. The values are not mandatory.

When the door or flap 3 is closed, the dishwasher cavity 2 is delimited circumferentially by three solid vertical walls 13 and two horizontal walls 15 in total, of which one forms a ceiling (above) and a further one forms a bottom (below) of the dishwasher cavity 2. In this context, the wall 14 which is arranged toward the front side V, toward a user standing in front of the dishwasher 1, and is able to move here, forms an inner element of the movable door or flap 3.

The wall 15 which forms the bottom of the dishwasher cavity 2 and delimits it substantially toward the bottom lies approximately horizontally, i.e. in parallel with an external floor B on which the dishwasher 1 stands.

At least one rotatable fan wheel 17 is arranged in the dishwasher cavity 2, with which air is able to be drawn in on one side and blown out on the other, wherein the at least one fan wheel 17 is assigned a motor 18, the rotational speed of which can be varied over time.

At a low rotational speed, a convection/flow is forced in the interior of the dishwasher cavity 2 or flow between the individual items to be washed. This—relatively slow-flow improves the removal of moisture on the surface of the dishware. As a result, the temperature during rinsing with rinse-aid can be reduced and thus energy can be saved.

At a high rotational speed, by contrast, such high flow velocities are generated that water puddles in cup bottoms, bowl bottoms or other depressions, particularly on the top side, are blown out over the respective edge of the item of dishware. In the subsequent drying process, only the surface then has to be dried.

The variation of the rotational speed may either be stored in a controller or may take place differently and adapted in each case in the form of regulation when determining drying parameters.

Figure 5:
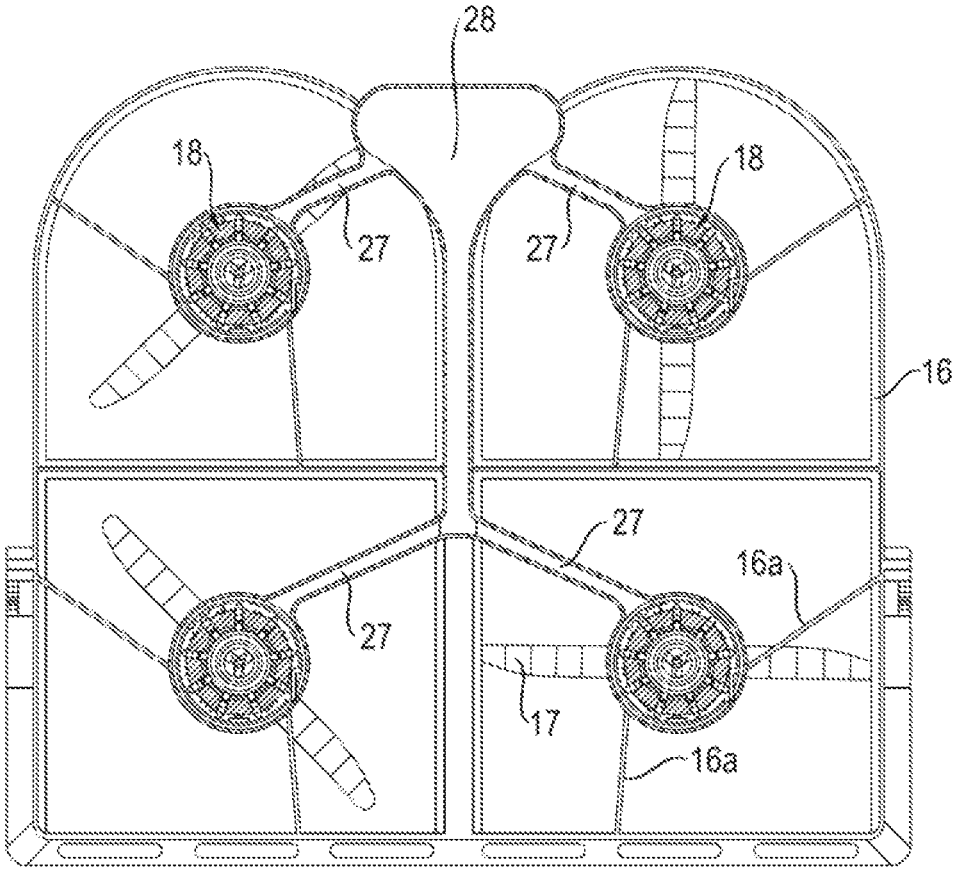
FIG. 5 shows a top view of the fan wheels arranged above, which here by way of example are held on a shared frame in a square-shaped arrangement.

In FIG. 5, a symmetrical arrangement of four fan wheels in a shared plane is shown by way of example. Just one large central fan wheel or also two or three fan wheels in the shared plane, possibly within a shared frame 16, would also be possible for example.

The fan wheel 17 or the fan wheels by way of example may be installed close below the upper ceiling 15 of the dishwasher cavity 2 (FIGS. 2, 3) or alternatively also may lie between the loading planes 10, 11 (not shown). An upper cutlery drawer 10 is not provided in FIGS. 2 and 3. Instead, the frame 16 with the fan wheels 17 is used here. Arranged above each fan wheel 17 can be a separate motor 18 which drives it. Alternatively, a plurality of fan wheels 17 also may be able to be driven by a shared motor—not shown here.

Here, the at least one motor 18 is a brushless, permanent magnet-excited synchronous motor, the rotational speed of which is simple to regulate and/or control. In particular, the motor 18 has an electronic commutation and preferably operates in a sensorless manner, but is also able to be realized with a sensor (Hall effect sensor, rotary encoder).

The at least one motor 18 may for example be able to be operated in a rotational speed range between 1,500 revolutions to 12,000 revolutions per minute, so that the aforementioned various operating modes result at low and at high rotational speeds.

Thus, the one or each motor 18 may be able to be operated in a continuous operation for the first operating mode, in a rotational speed range of less than 5,000 revolutions per minute during a program phase, for example the drying phase. In this rotational speed range, both volume and frequency of the motor and fan movement are pleasant in terms of acoustics. In this mode, the depicted convection support can be operated.

From this rotational speed range, brief boosts into a high rotational speed range from 5,000 to 12,000 revolutions per minute are able to be carried out for the second operating mode, for example such that the brief boosts each last less than 120 seconds, preferably around 90 seconds. In this operating mode, the blowing-out of the cavities, depressions etc. can take place, which can be effected with a high air throughput and a downward flow component. The higher flow noise is acceptable due to the brief interval duration, which may be repeated a number of times, for this operating mode.

A boost in the rotational speed of the motor assigned to the respective fan wheel is preferably able to be carried out during a blowing-off phase before the continuous operation following in time, wherein the rotational speed of the motor during the blowing-off phase is greater, in particular at least 20% greater, than the rotational speed of the motor during the continuous operation following in time. The blowing-off phase may preferably take place after the end of the liquid-carrying operation of the final liquid-carrying partial wash cycle, in particular rinse cycle with rinse-aid, if the recirculating pump has stopped its operation or has such a low rotational speed that washing liquid no longer travels over the one or more spray devices or, expressed more generally, liquid distribution devices, to strike the items to be washed, which have been washed and are now to be dried. The continuous operation of the motor may take place after the blowing-off phase, preferably during a temporary subsection or the entire remaining duration of the wash-cycle-concluding drying cycle of the wash cycle of a dishwashing program to be performed to support the convection in the dishwasher cavity.

Additionally, a blocking of a fan wheel 17, due to an improper loading for instance, is favorably able to be detected via a measurement of the motor current of a motor 18 assigned to said fan wheel 17 in each case. A corresponding warning signal can then be output.

A needs-based operation of the fan wheels 17 with a high degree of efficiency and cost advantages while adhering to safety standards is thus made possible. The quality is optimized in relation to the service life. There are also advantages in terms of wear and noise.

Figure 4:
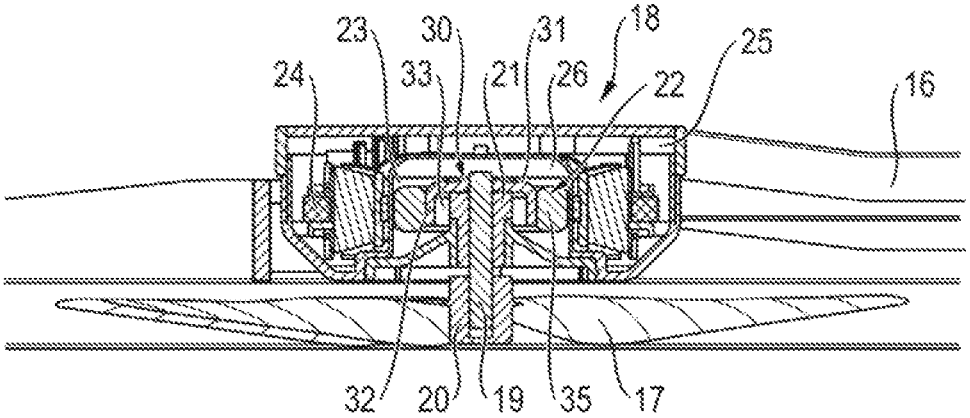
FIG. 4 shows a detailed view of a fan wheel with a drive motor therefor situated vertically above it.

The motor 18 for driving the fan wheel 17 shown here in detail in FIG. 4 is embodied as a wet rotor, i.e. at least the rotor 22 rotates in the wet region 26 and has a wet lubricant by way of the washing liquor. The rotor 22 rotates the shaft 19, which is rotatably mounted via a bearing assembly 21, in particular bearing sleeve, and then the winged wheel 17 via the fan wheel hub 20. The rotor 22 may in particular be formed by a ferrite ring.

Furthermore, the motor 18 embodied as a wet rotor comprises what is known as a motor can 23, which is somewhat pot-shaped and separates the wet-running rotor 22 from a stator 24 held in the dry area 25.

The ferrite ring, as a rotor 22, has certain emergency running properties in the motor can 23, in particular when it is formed from plastic, so that even a possible dry run, which cannot be ruled out, without lubrication by way of the washing liquor does not lead to damage in the motor 18 and this does not lead to the motor can 23 grinding through. The drive can therefore be embodied as free from a shaft sealing or other moving seal. The long-term durability is improved and wear is reduced. This emergency running property of the motor can be ensured, in particular in an improved manner, by the rotor chamber 26 being filled with water, or another fluid medium, or filling up with washing liquid during the washing operation. This is because a free, in particular liquid-filled gap remains intact between the rotor 22 and the motor can 23, without the rotor brushing against the motor can.

In particular, an inner bearing sleeve 21, in particular arranged in a stationary manner, is provided for the radial bearing assembly of the shaft 19 on one side of a shaft section arranged facing away from the fan wheel and in the motor can 12. Rotatably mounted therein is the section of the shaft 19 facing away from the fan wheel 17, about which a rotor is arranged on the outside with its rotor magnets or it magnetic ring, preferably ferrite magnetic ring, preferably in a substantially concentric manner. This inner bearing sleeve 21 preferably provides a radial bearing which is continuous over the axial extent of the rotor, or in particular a twin radial bearing, or a multiple radial bearing with more than two radial bearing points for the shaft 19. It replaces a conventional rotary bearing assembly of the shaft with an A-bearing before the front end face of the rotor facing the fan wheel and with a B-bearing behind the rear end face of the rotor facing away from the fan wheel. The shaft 19 is preferably connected via a coupling element 30 of the rotor 22 in a fixed manner. The coupling element 30 is preferably embodied in the form of a sleeve with a bottom 31, i.e. in the shape of a pot. The shaft 19 stands perpendicular to the bottom 31 of the pot-shaped coupling element 30 and runs from its input opening facing the fan wheel 17 toward the center thereof. In particular, the front-side end of the shaft facing away from the fan wheel 17 (from the opening of the pot-shaped coupling element 30) is guided through a through-opening in the center of the bottom 31 of the sleeve-shaped coupling element 30 and is grasped there in a twist-proof manner. The cylindrical jacket 32, in particular circular cylindrical jacket, of the sleeve-shaped coupling element 30 preferably has a radial gap distance 33 from the outer surface of the inner bearing sleeve 21. It is preferably arranged substantially concentric with respect to the inner bearing sleeve 21. The inner bearing sleeve 21 thus plugs into the cylindrical jacket 32 of the pot-shaped coupling element 30 with a subsection facing away from the fan wheel 17, in particular with its end section facing away from the fan wheel, or with its entire extent. This results in a flat design of the drive motor 18 which is pushed in an axial direction (when viewed along the shaft). Compared to a conventional drive motor with one bearing for the shaft before and after the rotor, it is shortened in terms of its axial extent. Mounted around the outside of the circular cylindrical jacket of the sleeve-shaped coupling element are one or more permanent magnets, and these are held there. The coupling element thus forms the magnetic bearing of the rotor. In particular, a ferrite ring can be arranged at and attached to the outer circumference of the sleeve-shaped coupling element. Thus, the coupling element 30 and the one or more rotor magnets mounted on its cylindrical jacket 32, in particular permanent magnets, form the rotor or the rotor unit 22. In this context, the rotor 22 revolves around the inner bearing sleeve 21 preferably arranged in a stationary manner during rotational operation of the motor 18. The end face of the inner bearing sleeve facing away from the fan wheel (when viewed along the central axis of the shaft) forms a thrust ring for the bottom of the sleeve-shaped coupling element. It provides an axial bearing for the sleeve-shaped coupling element 30 or for the rotor unit during rotational operation of the drive motor. This results in a combined radial and axial bearing for the unit consisting of drive shaft, coupling element and one or more rotor magnets.

Preferably, the material of the coupling element 30 is chosen to be different from the material of the inner bearing sleeve 21, so that the inner surface of the bottom 31 of the coupling element 30 facing the fan wheel 17 is able to slide on the end face of the inner bearing sleeve 21 facing away from the fan wheel in a largely low-friction manner, in particular on startup of the motor 18. No inadmissibly high degree of abrasion, i.e. wear, is able to occur between the bottom of the coupling element and the end face of the inner bearing sleeve, due to the favorable material combination thereof. In particular, a metal is chosen for the coupling element 30, while the inner bearing sleeve 21 is manufactured from a plastic material. A friction-reducer such as graphite, carbon, PTFE for instance can expediently be added thereto, or the bearing sleeve can be provided with an outer layer coating of a friction-reducer. A material is advantageously chosen for the shaft 19 which is different from the material of the bearing sleeve 21. In particular, it is preferably manufactured from a metal, such as stainless steel for example. This results in a very low-wear and maintenance-free bearing assembly consisting of shaft and/or rotor, which also functions reliably over many years of continuous operation and also has sufficiently favorable dry-running properties, as a dry run cannot be ruled out.

This specific embodiment of the motor(s) 18 is particularly advantageously combined with the described rotational speed variations. The one or more motors 18 may be arranged axially directly above the fan wheels 17 assigned to it, so that a compact structural unit is formed from the drive motor and fan wheel in each case, which has only a very small structural height. In particular, the respective fan wheel is embodied as an axial fan. The electric motor assigned to it is embodied and/or arranged such that its shaft in particular projects vertically downward. Expediently, the fan wheel is attached to the free end of the shaft which protrudes downward. At its end facing away from the fan wheel, it is preferably only mounted on one side—as described above. If, in a liquid-carrying partial wash cycle, such as the cleaning cycle of the wash cycle of a dishwashing program to be performed, washing liquid is distributed in the interior of the dishwasher cavity by means of one or more liquid distribution devices, in particular is sprayed, then the washing liquid may possibly also reach the rotor chamber of the drive motor provided by the pot of the motor can from below, where it supplies a liquid lubrication of the shaft and/or the rotor. This may be favorable for a rotational operation of the drive motor later in time, e.g., during a blowing-off phase or the drying phase of the wash cycle.

In particular, the respective drive motor 18 has an axial extent of less than four centimeters, wherein the overall structural height of the motor 18 and fan wheel 17 then favorably amounts to less than five centimeters. The restriction for the remaining loading height in the dishwasher cavity 2 is minimized as a result.

The frame 16 may also be part of a loading plane 10, 11, so that the one or the plurality of fan wheel(s) 17 is/are directly assigned to a cutlery drawer 10 and/or a basket 11. The installation height is minimized as a result, and the structural outlay is low.

An electrical contacting of the motors 18 can be ensured via cable conduits 27 which branch off from a central conduit 28 and are sealed.

The invention claimed is:

1. A household dishwasher comprising:

a dishwasher cavity for receiving items to be washed;

a plurality of rotatable fan wheels held on and sharing a common frame disposed below and in proximity to an upper ceiling of the dishwasher cavity, said plurality of rotatable fan wheels configured to draw in air and to blow out the air over a top portion of the items to be washed; and a separate motor operably connected to each of the plurality of rotatable fan wheels and operating at a rotational speed which is variable over time, wherein each motor is configured to operate in a continuous operation at a rotational speed of less than 5,000 revolutions per minute during a program phase, and is configured to also operate in a boost operation at a higher rotational speed in a range of 5,000 to 12,000 revolutions per minute during a blowing-off phase than during the continuous operation, wherein the boost operation that is carried out during the blowing-off phase occurs before the continuous operation, and wherein during operation of each motor in the boost operation during the blowing-off phase, the plurality of rotatable fan wheels blow out air over the top portion of the items to be washed at such a velocity to blow out any water puddles on the top portion of the items to be washed over respective edges of the item to be washed.

2. The household dishwasher of claim 1, wherein each motor is an electronically commutated, permanent magnet-excited synchronous motor.

3. The household dishwasher of claim 1, wherein each motor is configured to operate in a rotational speed range from 1,500 revolutions to 12,000 revolutions per minute.

4. The household dishwasher of claim 1, wherein the boost operation lasts less than 120 seconds.

5. The household dishwasher of claim 1, wherein the rotational speed of each motor during the blowing-off phase is at least 20% greater than the rotational speed of each motor during the continuous operation which follows in time.

6. The household dishwasher of claim 1, wherein each motor is configured for measurement of a motor current and determination of a blocking of a corresponding fan wheel.

7. The household dishwasher of claim 1, wherein each motor is configured for control or regulation to a desired rotational speed in a sensorless manner.

8. The household dishwasher of claim 1, wherein each motor is arranged above a corresponding fan wheel.

9. The household dishwasher of claim 1, wherein each motor has an axial extent of less than four centimeters.

10. The household dishwasher of claim 1, wherein each motor and a corresponding fan wheel have an overall structural height which is less than five centimeters.

11. The household dishwasher of claim 1, wherein the plurality of rotatable fan wheels is assigned to a cutlery drawer and/or a basket.

12. The household dishwasher of claim 1, wherein the plurality of fan wheels comprises four fan wheels held on the shared frame in a square-shaped arrangement when viewed from above.

* * * * *